US008477167B2

(12) United States Patent
Kato et al.

(10) Patent No.: US 8,477,167 B2
(45) Date of Patent: Jul. 2, 2013

(54) THERMAL PRINTER AND METHOD OF FORMING IMAGE

(75) Inventors: Hiroaki Kato, Kanagawa (JP); Yasushi Hirumi, Kanagawa (JP)

(73) Assignee: Sony Corporation, Tokyo (JP)

( * ) Notice: Subject to any disclaimer, the term of this patent is extended or adjusted under 35 U.S.C. 154(b) by 753 days.

(21) Appl. No.: 11/823,393

(22) Filed: Jun. 27, 2007

(65) Prior Publication Data

US 2008/0002014 A1 Jan. 3, 2008

(30) Foreign Application Priority Data

Jul. 3, 2006 (JP) ..... P2006-183909

(51) Int. Cl.
*B41J 2/325* (2006.01)

(52) U.S. Cl.
USPC ..... 347/217; 347/215; 347/219

(58) Field of Classification Search
USPC ..... 347/217, 171, 215, 219
See application file for complete search history.

(56) References Cited

U.S. PATENT DOCUMENTS

| | | | | |
|---|---|---|---|---|
| 5,668,585 | A * | 9/1997 | Brechko | 347/220 |
| 5,965,485 | A * | 10/1999 | Mizumachi et al. | 503/227 |
| 6,092,942 | A * | 7/2000 | Koichi et al. | 400/120.02 |
| 2005/0064320 | A1 * | 3/2005 | Simpson et al. | 430/199 |
| 2005/0140769 | A1 * | 6/2005 | Kanemaru et al. | 347/172 |

FOREIGN PATENT DOCUMENTS

| | | |
|---|---|---|
| JP | 09-272266 | 10/1997 |
| WO | WO 97 39898 | 10/1997 |

* cited by examiner

*Primary Examiner* — Stephen Meier
*Assistant Examiner* — Sarah Al Hashimi
(74) *Attorney, Agent, or Firm* — Robert J. Depke; The Chicago Technology Law Group, LLC

(57) ABSTRACT

A thermal printer is disclosed. The thermal printer includes a thermal head on which plural heat-generating elements are arrayed; and a platen mounted opposite to the thermal head. The thermal printer uses an ink ribbon and paper held between the thermal head and the platen, and the thermal printer performs printing by causing the heat-generating elements to generate heat such that inks of the ink ribbon are transferred to the paper. The ink ribbon has a base film on which color inks and a transparent laminate ink are successively and repetitively arranged, and a pressure force acting between the thermal head and the platen is made different between when the color inks are transferred and when the laminate ink is transferred.

2 Claims, 9 Drawing Sheets

THERMAL PRINTER AND METHOD OF FORMING IMAGE

CROSS REFERENCES TO RELATED APPLICATIONS

The present invention contains subject matter related to Japanese Patent Application JP2006-183909 filed in the Japanese Patent Office on Jul. 3, 2006, the entire contents of which being incorporated herein by reference.

BACKGROUND OF THE INVENTION

1. Field of the Invention

The present invention relates to a thermal printer for printing an image by placing an ink ribbon and paper between a thermal head and a platen and transferring the inks of the ink ribbon onto the paper. The invention also relates to a method of forming an image using the thermal printer. More particularly, the invention relates to a technique for producing vivid visual effects by forming sufficient convexes and concaves on the surface of the paper.

2. Description of the Related Art

A thermal printer having a thermal head including arrays of plural heat-generating elements (such as heat-generating resistors) and a platen (e.g., a platen roller) mounted opposite to the thermal head has been heretofore known. Main printing methods used by such a thermal printer include sublimation method, melting method, and heat-sensitive method. The thermal head is pressed against paper used for printing (such as roll paper) conveyed onto the platen from over the ink ribbon to perform printing. That is, in any printing method, plural heat-generating resistors are arrayed on the thermal head, and the resistors are selectively energized electrically according to gray levels. Printing is performed on the roll paper by making use of thermal energy produced at that time.

For example, in the case of sublimation line type thermal printer, heat-generating resistors are arranged in lines on a thermal head. An ink ribbon and roll paper are conveyed into the space between the thermal head and the platen roller. The head is pressed against the platen roller to hold the ribbon and the paper therebetween. Then, the heat-generating resistors of the thermal head are selectively activated electrically. The inks of the ink ribbon are sublimated by the thermal energy produced at this time and transferred onto the roll paper. Consequently, an image is created.

Generally, the ink ribbon used for such a thermal printer is wound in the space between the supply reel and the take-up reel within a ribbon cassette. Different color inks (e.g., inks of yellow (Y), magenta (M), and cyan (C)) and a transparent laminate ink (L) are successively and repetitively arranged on a base film in a direction perpendicular to the direction in which the ink ribbon is wound off the reel (direction of conveyance). The color inks (Y, M, C) are successively transferred to the roll paper based on information about an image to be printed. Thus, an image is created.

The transparent laminate ink (L) is used to protect the image formed by the color inks (Y, M, C). That is, a totally transparent laminate layer is formed by thermal transfer from over the image made up of the color inks (Y, M, C), thus improving the chemical resistance, solvent resistance, resistance to greases and oils, wear resistance, and other characteristics of the color image. Furthermore, the transparent laminate layer enhances the glossiness of the surface of the formed color image and thus the image quality can be improved.

In this way, the thermal printer forms a color image on the roll paper by the color inks (Y, M, C) and protects the color image by the transparent laminate ink (L). In the stage when the laminate ink (L) is transferred, a matting step for forming a convexo-concave pattern on the surface of the color image may be performed. That is, unevenness created by the matting step can impart desired surface properties such as delustering and net pattern to the color image while retaining the function of the laminate ink (L) for protecting the image.

For example, JP-A-9-272266 (patent reference 1) described below discloses a technique for obtaining arbitrary surface properties by appropriately selecting transfer patterns to form concave portions corresponding to the heating portions of the heat-generating resistors and convex portions corresponding to the non-heating portions when a laminate ink (L) is transferred after a color image is formed on roll paper, so that the surface of the laminate layer is formed into a convexo-concave pattern.

WO 97/39898 (patent reference 2) described below discloses a technique for performing matting processing that produces visually great effects by reading a convexo-concave pattern from a memory when a laminate ink (L) is transferred after a color image is formed on roll paper and forming a net pattern or random convexo-concave pattern by the laminate ink (L).

SUMMARY OF THE INVENTION

In this way, according to the techniques described in the above-cited patent references 1 and 2, the surface of a color image can be matted by imparting a convexo-concave pattern to a transferred laminate layer when a laminate ink (L) for protecting the color image is transferred after the color image is formed on roll paper by color inks (Y, M, C).

However, the laminate layer which is transferred to a color image and formed by the techniques described in such patent references 1 and 2 is much thinner than the roll paper. Therefore, if any convexo-concave pattern is given to the thin laminate layer, the difference between concave and convex portions is very small. Consequently, there is a limitation in the degree of the unevenness. That is, it cannot be said that the convexo-concave pattern formed by the techniques described in patent references 1 and 2 is sufficiently rough. There is the problem that it is difficult to obtain visually vivid matte effects.

Accordingly, it is desirable to provide a technique which can form relatively large roughness on the surface of roll paper itself and which can produce sufficient visual effects such as delustering (matte effects) and mesh pattern by the roughness created by matting processing while retaining the function of a transparent laminate layer for protecting an image.

An embodiment of the present invention provides a thermal printer having a thermal head on which plural heat-generating elements are arrayed and a platen mounted opposite to the thermal head. An ink ribbon and paper are held between the thermal head and the platen. Inks of the ink ribbon are transferred to the paper to perform printing by causing the heat-generating elements to generate heat. The ink ribbon has a base film on which color inks and a transparent laminate ink are successively and repetitively arranged. The pressure force at which the thermal head is pressed against the platen is made different between when the color inks are transferred and when the laminate ink is transferred.

Another embodiment of the present invention provides a method of forming an image by a thermal printer having a thermal head and a platen mounted opposite to the thermal head. Plural heat-generating elements are arrayed on the thermal head. An ink ribbon and paper are held between the thermal head and the platen. Inks of the ink ribbon are transferred to the paper to perform printing by causing the heat-generating elements to generate heat. The ink ribbon has a base film on which color inks and a transparent laminate ink are successively and repetitively arranged. The pressure force at which the thermal head is pressed against the platen is made different between when the color inks are transferred and when the laminate ink is transferred. In this way, irregularities are formed on the surface of the paper.

In the above-described embodiments of the invention, the ink ribbon has the base film on which the color inks and transparent laminate ink are successively and repetitively arranged. The pressure force at which the thermal head is pressed against the platen is made different between when the color inks are transferred and when the transparent laminate ink is transferred. Therefore, irregularities can be formed on the surface of the paper itself by variations in the pressure force of the thermal head. That is, if the pressure force of the thermal head is increased, the strong pressure force is applied to the paper and so the surface of the paper itself is crushed by thermal deformation, forming relatively large concaves. On the other hand, if the pressure force of the thermal head is reduced, the surface of the paper hardly deforms. Consequently, portions that are made convex relative to the concaves are formed.

According to the above embodiments of the invention, irregularities can be formed on the surface of the paper itself by varied pressure force of the thermal head. That is, irregularities are formed on the paper that is relatively thick rather than on a very thin laminate layer.

Therefore, in the formed convexo-concave pattern, convex and concave portions are sufficiently different. Hence, visually vivid matte effects can be obtained.

DESCRIPTION OF THE PREFERRED EMBODIMENTS

Embodiment of the present invention are hereinafter described with reference to the drawings.

Figure 1:
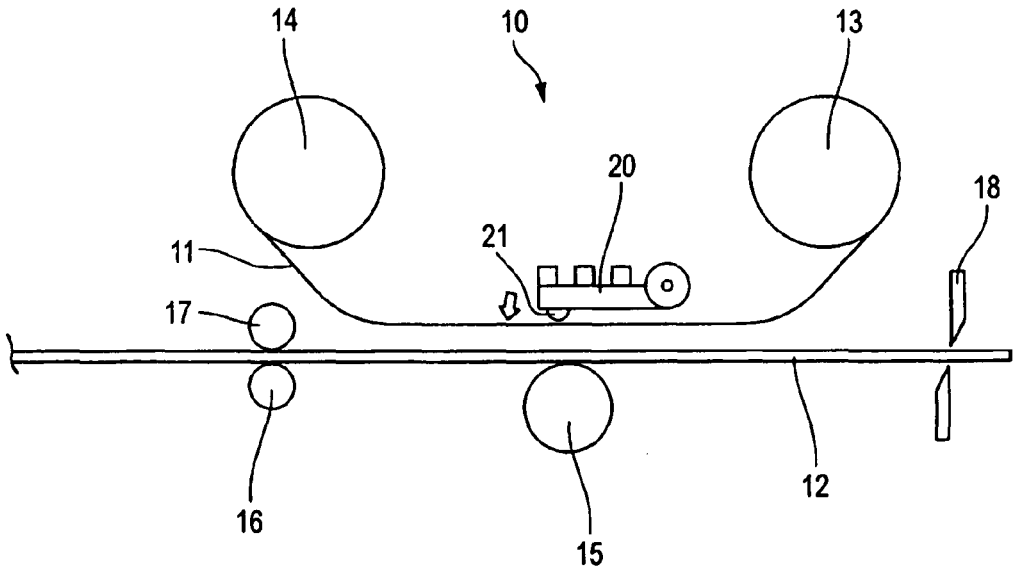
FIG. 1 is a side elevation of a thermal printer according to one embodiment of the present invention.

FIG. 1 is a side elevation showing a thermal printer 10 according to one embodiment of the present embodiment. The thermal printer 10 corresponds to color printing. An ink ribbon 11 to which three color inks (yellow (Y), magenta (M), and cyan (C)) are applied together with a transparent laminate ink (L) is mounted on the printer.

The thermal printer 10 is of the dye sublimation type and sublimates the sublimation inks applied on the ink ribbon 11 by making use of thermal energy produced when plural heat-generating resistors 21 (corresponding to heat-generating elements in the present invention) arrayed on a thermal head 20 are electrically energized. The inks are transferred to roll paper 12 (corresponding to paper in the present invention) to perform printing.

The thermal head 20 can be moved toward and away from a platen roller 15 (corresponding to the platen in the present invention) mounted opposite to the thermal head 20. When printing is performed, the thermal head 20 descends and is pressed against the platen roller 15. The magnitude of the pressure force between the head 20 and the roller 15 when printing is performed can be adjusted continuously by pressure force-adjusting means (described later).

In the thermal printer 10 constructed in this way, the ink ribbon 11 partitioned into different colors is housed in a ribbon cassette (not shown). The ribbon is pulled out from a supply reel 13 rotated as indicated by the arrow in FIG. 1 in response to grayscale data that has undergone a color conversion. Then, the ribbon passes between the thermal head 20 and the platen roller 15 while guided by a guide roller (not shown). The ribbon is conveyed in steps to the left as viewed in FIG. 1 toward a take-up reel 14.

Meanwhile, the roll paper 12 is set in a given position within the thermal printer 10. The paper is pulled from the printer and conveyed according to the need. That is, the roll paper 12 pulled out is guided by a paper transport path (not shown), passes between the head 20 and the platen roller 15, is held between a capstan roller 16 and a pinch roller 17, and is conveyed forward or rearward (left or right as viewed in FIG. 1) by forward or rearward rotation of the capstan roller 16. After end of printing performed by the thermal head 20, the paper is cut into a given length by a cutter 18 and discharged from a discharge port (not shown). When printing is started, the front end of the roll paper 12 passes across the head 20 and is conveyed to the right as viewed in FIG. 1 until the starting point of printing on the paper 12 becomes opposite to the heat-generating resistors 21 of the head 20.

When a printing instruction is input to the thermal printer 10, the thermal head 20 that was ascending in the state shown in FIG. 1 descends as indicated by the arrow. The heat-generating resistors 21 push against the platen roller 15. The ink ribbon 11 and roll paper 12 are held between the head 20 and platen roller 15. That is, the head 20 is displaced toward the platen roller 15. As a result, a pressure force acts between the thermal head 20 and platen roller 15 via the ink ribbon 11 and roll paper 12.

Under this condition, when grayscale data is entered, the capstan roller 16 rotationally driven in a counterclockwise direction and the following pinch roller 17 convey the roll paper 12 in steps to the left as viewed in FIG. 1. At the same time, the ink ribbon 11 is pulled out from the supply reel 13 and conveyed in steps to the left as viewed in FIG. 1 toward the take-up reel 14. The heat-generating resistors 21 of the thermal head 20 are selectively electrically energized. Heat generated from the resistors 21 is transferred to the ink ribbon 11. Consequently, color ink of yellow (Y) on the ribbon 11 is sublimated and transferred to the roll paper 12. As a result, printing is performed.

In the case of color printing, printing is performed for each color. Therefore, whenever the ink ribbon 11 is conveyed and the transferred color is changed, the capstan roller 16 is rotated in a reverse direction (counterclockwise), and the roll paper 12 is conveyed to the right as viewed in FIG. 1 and returned to the printing start position. Similarly, color inks of magenta (M) and cyan (C) are transferred. That is, after the roll paper 12 is pulled out first, the three color inks of yellow (Y), magenta (M), and cyan (C) are transferred. The paper makes 3 reciprocations until a color image is formed. Finally, the transparent laminate ink (L) is transferred. Then, the paper 12 is cut by the cutter 18 without being returned to the starting point. The paper is discharged from the discharge port (not shown). Consequently, the printing is ended when the paper makes 3 and a half reciprocations in total.

In this way, the thermal printer 10 shown in FIG. 1 of the present embodiment has the thermal head 20 and the platen roller 15 mounted opposite to the head 20 on which the plural heat-generating resistors 21 are arrayed. The ink ribbon 11 and roll paper 12 are held between the head 20 and platen roller 15. The inks on the ink ribbon 11 are transferred onto the roll paper 12 by causing the heat-generating resistors 21 to generate heat. Thus, printing is performed. The ink ribbon 11 is applied with the 3 color inks of Y, M, C and the transparent laminate ink (L).

The structures of the ink ribbon 11 and roll paper 12 constructed as described so far are next described in detail.

Figure 2:
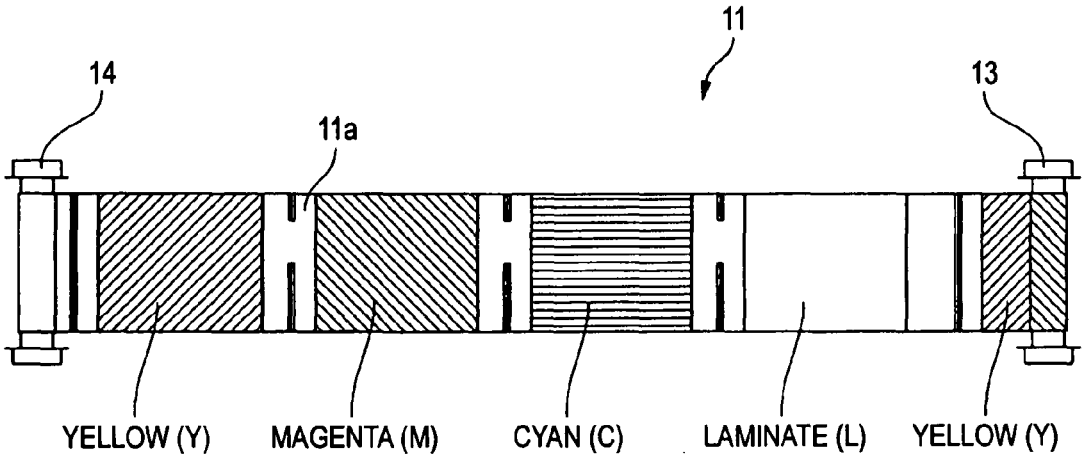
FIG. 2 is a plan view of an ink ribbon used in the thermal printer of the embodiment.

FIG. 2 is a plan view showing the ink ribbon 11 for use in the thermal printer 10 of the present embodiment.

As shown in FIG. 2, the ink ribbon 11 is wound between the supply reel 13 located within the ribbon cassette (not shown) and the take-up reel 14. The three color inks of yellow (Y), magenta (M), cyan (C) and the transparent laminate ink (L) are successively and repetitively arranged on the base film 11*a* in the direction of conveyance of the ribbon 11 (in the leftward direction in FIG. 2) and in a direction perpendicular to the direction in which the ribbon is wound off the supply reel.

The laminate ink (L) includes a transparent thermosetting resin to which an ultraviolet absorbing agent is added. Each of the color inks of Y, M, C is transferred onto the roll paper 12 (see FIG. 1) and a color image is created. Then, the laminate ink is transferred to overlap the color image. That is, the transparent laminate ink (L) is arranged subsequently to the color inks of yellow (Y), magenta (M), and cyan (C). Because the laminate ink is laminated on the formed color image, the laminate ink acts like a protective film. The chemical resistance, solvent resistance, resistance to greases and oils, wear resistance, and other characteristics are improved. Furthermore, the transparent laminate ink (L) enhances the glossiness of the surface of the color image and thus the image quality can be improved.

Figure 3:
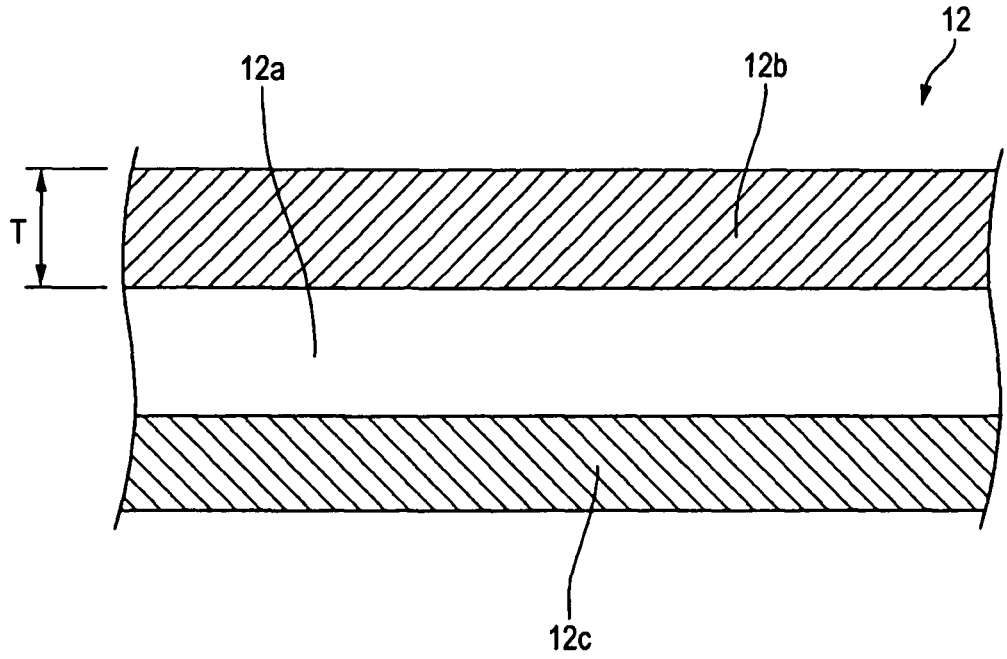
FIG. 3 is a fragmentary cross section of roll paper used in the thermal printer of the embodiment.

FIG. 3 is a fragmentary cross section of the roll paper 12 for use in the thermal printer 10 of the present embodiment.

As shown in FIG. 3, the roll paper 12 includes a base material 12*a* made of wood pulp, a surface layer 12*b* formed on one surface (pressure contact surface of the thermal head 20 shown in FIG. 1) of the base material 12*a* and having an ink-receiving layer, and a backing layer 12*c* formed on the other surface of the base material 12*a* and acting to improve the smoothness of motion.

The surface layer 12*b* has the ink-receiving layer which receives the color inks (Y, M, C) transferred from the ink ribbon 11 (see FIG. 2) and which retains the formed color image. The ink-receiving layer is chiefly made of a thermosetting resin such as acrylic resin, polyester resin, polycarbonate resin, or polyvinyl chloride resin. The surface layer 12*b* also includes a resinous layer inserted as a base layer between the base material 12*a* and the ink-receiving layer to improve the intimateness between the base layer and the ink-receiving layer in a case where the base material 12*a* is made of wood pulp.

In the initial state, the surface layer 12*b* has a thickness of T. When the heat-generating resistors 21 of the thermal head 20 shown in FIG. 1 are pressed and caused to generate heat for printing, the resilience of the surface layer is lost by the thermal energy. Consequently, the thickness T decreases. That is, since the surface layer 12*b* is made of a thermosetting resin as described above, the surface layer is thermally deformed by the given pressure force applied by the thermal head 20 and by the thermal energy produced from the heat-generating resistors 21. Hence, the surface layer is crushed, producing concaves.

On the other hand, the backing layer 12*c* is formed to reduce the frictional force between the backing layer 12*c* and the platen roller 15 (see FIG. 1) to permit the roll paper 12 to travel stably. Main examples of the material of the backing layer include thermosetting resins such as acrylic resin, polyester resin, polyvinyl chloride resin, and vinyl acetate resin. The presence or absence of the backing layer 12*c* may be appropriately determined according to the application or specification of the roll paper 12.

In this way, in the ink ribbon 11 shown in FIG. 2, the color inks (Y, M, C) and transparent laminate ink (L) are successively and repetitively arranged on the base film 11*a*. The roll paper 12 shown in FIG. 3 has the surface layer 12*b* in the surface pressed against the head 20, the surface layer being depressed by the pressure force and thermal energy from the thermal head 20. In the thermal printer 10 of the present embodiment, the pressure force between the head 20 and the platen roller 15 (applied to the surface layer 12*b* of the roll paper 12 by the heat-generating resistors 21 of the head 20) is made different between when the color inks (Y, M, C) of the ink ribbon 11 are transferred and when the transparent laminate ink (L) is transferred.

The structure of this thermal head 20 is next described in detail.

Figure 4:
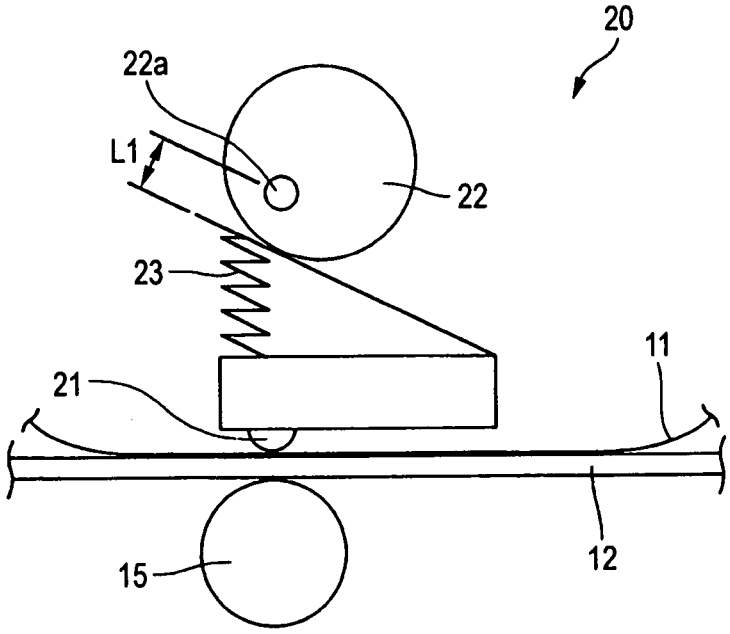
FIG. 4 is a side elevation of a thermal head for use in the thermal printer of the embodiment, showing the state in which the roll paper is transported.
Figure 5:
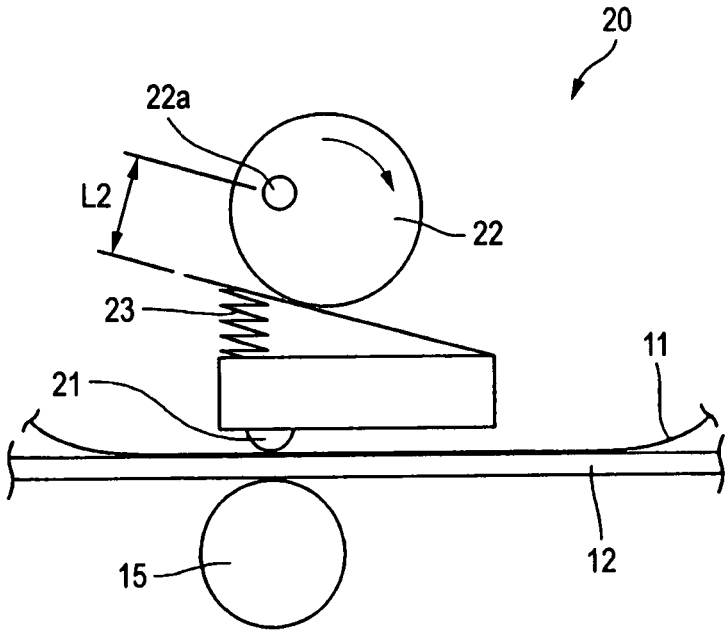
FIG. 5 is a side elevation of the thermal head for use in the thermal printer of the embodiment, showing the state in which the color inks of the ink ribbon are transferred.
Figure 6:
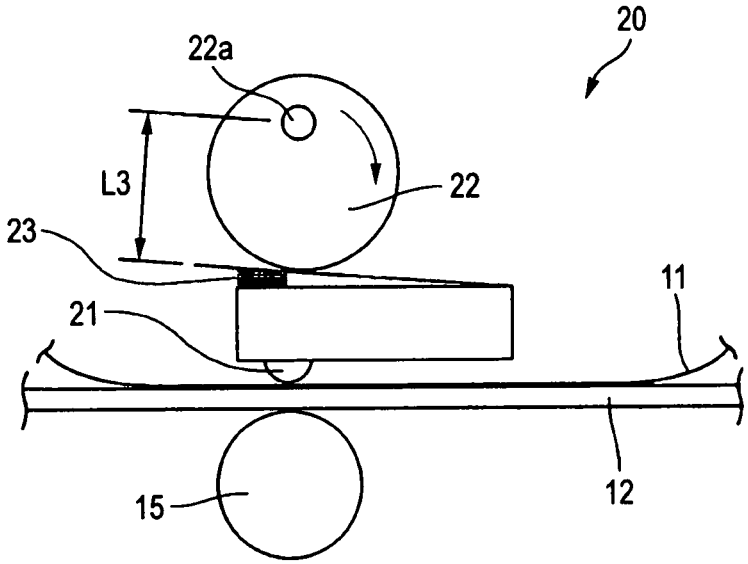
FIG. 6 is a side elevation of the thermal head for use in the thermal printer of the embodiment, showing the state in which the laminate ink of the ink ribbon is transferred.

FIGS. 4 to 6 are side elevations of the thermal head 20 in the thermal printer 10 of the present embodiment.

FIG. 4 shows the state in which the roll paper 12 is transported. FIG. 5 shows the state in which the color inks (Y, M, C) of the ink ribbon 11 are transferred. FIG. 6 shows the state in which the laminate ink (L) of the ink ribbon 11 is transferred.

As shown in FIG. 4, the thermal head 20 is mounted opposite to the platen roller 15. The ink ribbon 11 and roll paper 12 are held between the head and platen roller 15. The head has the heat-generating resistors 21 for transferring the inks (Y, M, C, L) of the ink ribbon 11 onto the roll paper 12 by causing the resistors 21 to generate heat.

The thermal head 20 is equipped with pressure force-adjusting means capable of continuously adjusting the pressure force between the head 20 and the platen roller 15. The pressure force-adjusting means includes an eccentric cam 22 and a spring 23 pushing against the thermal head 20. The cam 22 is rotated in a clockwise direction by a rotating shaft 22*a* located off the center. That is, the eccentric cam 22 is mounted to an upper part of the head 20. The cam 22 pushes against the head 20 via the spring 23.

The interval between the rotating shaft 22*a* of the eccentric cam 22 and the platen roller 15 is kept at a constant distance. Therefore, when the cam 22 is rotated, the amount of contraction of the spring 23 varies. As a result, the repulsive force of the spring 23 increases or decreases. That is, if the spring 23 is contracted by rotating the eccentric cam 22, the pressure force between the heat-generating resistors 21 and the platen roller 15 increases. Conversely, if the cam 22 is rotated to a position at which the spring 23 is expanded, the pressure force between the heat-generating resistors 21 and the platen roller 15 weakens. In the thermal printer 10 of the present embodiment, the pressure force is made different among (i) when the roll paper 12 is transported, (ii) when the color inks (Y, M, C) of the ink ribbon 11 are transferred, and (iii) when the laminate ink (L) of the ribbon 11 is transferred.

FIG. 4 shows the state of the roll paper 12 when it is transported. The eccentric cam 22 is rotated to minimize the distance L1 between the rotating shaft 22*a* of the cam 22 and the upper end of the spring 23. The spring 23 hardly contracts. Therefore, when the roll paper 12 shown in FIG. 4 is transported, the pressure force between the heat-generating resistors 21 and the platen roller 15 is almost zero. Consequently, the pressure force does not hinder the conveyance of the roll paper 12. The paper 12 can be smoothly conveyed.

FIG. 5 shows the state in which the color inks (Y, M, C) of the ink ribbon 11 are transferred. In order to transfer the color inks (Y, M, C), it may be necessary that the heat-generating resistors 21 press against the roll paper 12 via the ink ribbon 11 over the platen roller 15 at some degree of strength. Therefore, when the color inks (Y, M, C) are transferred, the eccentric cam 22 is rotated as indicated by the arrow such that the distance L2 between the rotating shaft 22*a* of the cam 22 and the upper end of the spring 23 assumes an appropriate value. A requisite amount of contraction of the spring 23 is secured. The pressure force between the heat-generating resistors 21 and the platen roller 15 is made equal to the minimum pressure force necessary for printing. Accordingly, when the color inks (Y, M, C) shown in FIG. 5 are transferred, heat produced from the heat-generating resistors 21 is effectively transferred to the ink ribbon 11 by an appropriate pressure force. The color inks (Y, M, C) on the ink ribbon 11 are sublimated. The inks are transferred to the roll paper 12, where printing is performed.

When the heat-generating resistors 21 push against the roll paper 12 via the ink ribbon 11 and thermal energy is supplied from the resistors 21, the surface layer 12*b* (see FIG. 3) of the roll paper 12 becomes thermally deformed, so that the layer is crushed.

However, when the color inks (Y, M, C) are transferred, the pressure force at the thermal head 20 is the minimum force necessary for printing as described above. Therefore, it is unlikely that the surface layer 12*b* of the paper 12 is depressed greatly. Rather, sufficient resilience is left in the surface layer 12*b*.

FIG. 6 shows the state in which the transparent laminate ink (L) is transferred. To transfer the laminate ink (L), it may be necessary that the heat-generating resistors 21 push against the roll paper 12 via the ink ribbon 11 over the platen roller 15, in the same way as when the color inks (Y, M, C) are transferred. In the thermal printer 10 of the present embodiment, the pressure force produced when the transparent laminate ink (L) is transferred is made greater than the pressure force produced when the color inks (Y, M, C) are transferred. That is, when the laminate ink (L) is transferred, a pressure force that is 1.2 to 2 times as great as the force applied when the color inks (Y, M, C) are transferred is applied.

The pressure force applied when the laminate ink (L) is transferred is increased in this way to form a convexo-concave pattern on the surface of the roll paper 12 by variations in the pressure force of the thermal head 20. That is, if the pressure force from the head 20 is strong, the strong force is applied to the roll paper 12. The surface layer 12*b* (see FIG. 3) that retains its resilience after transfer of the color inks (Y, M, C) is further crushed by thermal deformation. Therefore, relatively large recesses can be formed according to the need. The resulting convexo-concave pattern produces visually sufficient matte effects.

Accordingly, when the laminate ink (L) is transferred, the eccentric cam 22 is appropriately rotated such that the distance L3 between the rotating shaft 22*a* of the cam 22 and the upper end of the spring 23 is increased. The amount of contraction of the spring 23 is increased. Accordingly, the pressure force between the heat-generating resistors 21 and the platen roller 15 is increased according to the need. It is possible to achieve formation of large recesses in the surface of the roll paper 12 in addition to transfer of the laminate ink (L).

This point is described in greater detail. The pressure force between the heat-generating resistors 21 and the platen roller 15 can be adjusted continuously according to the rotational position of the eccentric cam 22 when the rotating shaft 22*a* rotates. More specifically, the pressure force applied when the transparent laminate ink (L) is transferred is made 1.2 to 2 times as large as the force applied when the color inks (Y, M, C) are transferred by appropriately adjusting the rotational position of the cam 22. As a result, the surface of the roll paper 12 is appropriately recessed while the laminate ink (L) is being transferred. Hence, an arbitrary convexo-concave pattern can be formed. In this way, according to the thermal printer 10 of the present embodiment, desired surface properties such as delustering and mesh pattern can be produced.

Figure 7:
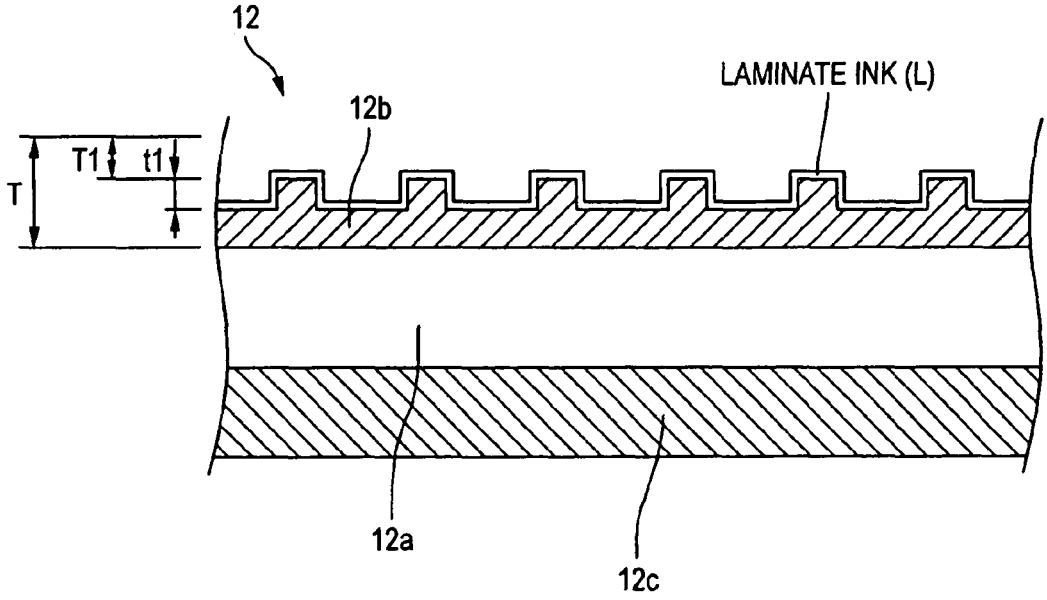
FIG. 7 is a cross-sectional view showing one example of convexo-concave pattern formed on roll paper by the thermal printer of the embodiment.

FIG. 7 is a cross-sectional view of one example of convexo-concave pattern (having sufficient convexes and concaves) formed on the roll paper 12 by the thermal printer 10 of the present embodiment.

Figure 8:
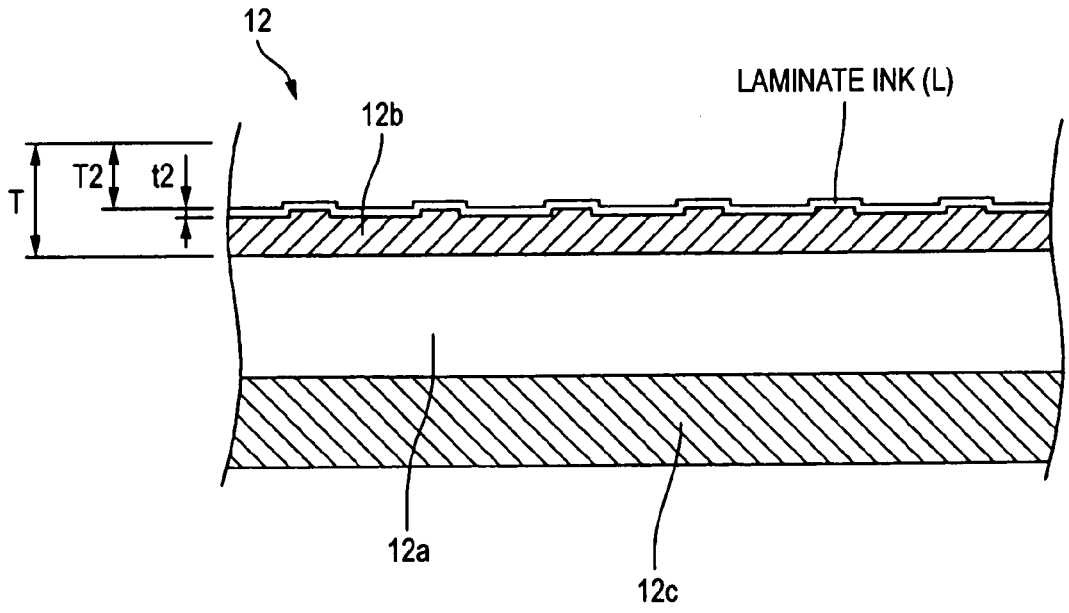
FIG. 8 is a cross-sectional view showing a comparative example of convexo-concave pattern formed on roll paper.

FIG. 8 is a cross-sectional view of a comparative example of convexo-concave pattern formed on the roll paper 12, the pattern having only gentle convexes and concaves.

The convexo-concave pattern of the comparative example shown in FIG. 8 is first described. When the color inks of the yellow (Y), magenta (M), and cyan (C) are transferred, if a strong pressure force that has been generally used from the past is applied to the roll paper 12, the surface layer 12*b* having the original thickness T is crushed at this time by thermal deformation by an amount T2. Therefore, when the last laminate ink (L) is transferred, the surface layer 12*b* loses its resilience.

Under this condition, if a matting step for imparting a convexo-concave pattern to the surface layer 12*b* is performed in the stage when the laminate ink (L) is transferred, only shallow recesses t2 are formed by transfer of the laminate ink (L). It may be difficult to form convexes and concaves on the roll paper 12 itself whose surface layer 12*b* has been crushed out.

Therefore, if the pressure force applied when the laminate ink (L) is transferred is equal to or less than the force applied when the color inks (Y, M, C) are transferred, only a gentle convexo-concave pattern having recesses of t2 is formed as shown in FIG. 8. With these convexes and concaves, sufficient matte effects would not be obtained. This tendency is especially conspicuous when the roll paper 12 uses the base material 12*a* made of a thermosetting resin. It has been difficult to obtain visually vivid matte effects.

However, in the thermal printer 10 of the present embodiment, the pressure force applied when the laminate ink (L) is transferred is made stronger than the force applied when the color inks (Y, M, C) are transferred. That is, if a strong pressure force as used heretofore when the color inks (Y, M, C) are transferred is applied to the roll paper 12, the resilience of the surface layer 12*b* is lost at this stage. Therefore, in the thermal printer 10 of the present embodiment, a minimum pressure force necessary for printing is applied when the color inks (Y, M, C) are transferred. Consequently, as shown in FIG. 7, the surface layer 12*b* having the original thickness of T is crushed only by T1 (T1<T2). In this way, the resilience of the surface layer 12*b* is left.

Then, when the last laminate ink (L) is transferred, the surface layer 12*b* can be crushed further by applying a pressure force stronger than the force used when the color inks (Y, M, C) are transferred. Therefore, a deep convexo-concave pattern having recesses of a depth of t1 (t1>t2) can be formed in the surface layer 12*b* itself. As a result, as shown in FIG. 7, a convexo-concave pattern having the recesses of the sufficient depth t1 can be formed. Visually vivid matte effects can be obtained.

Figure 9:
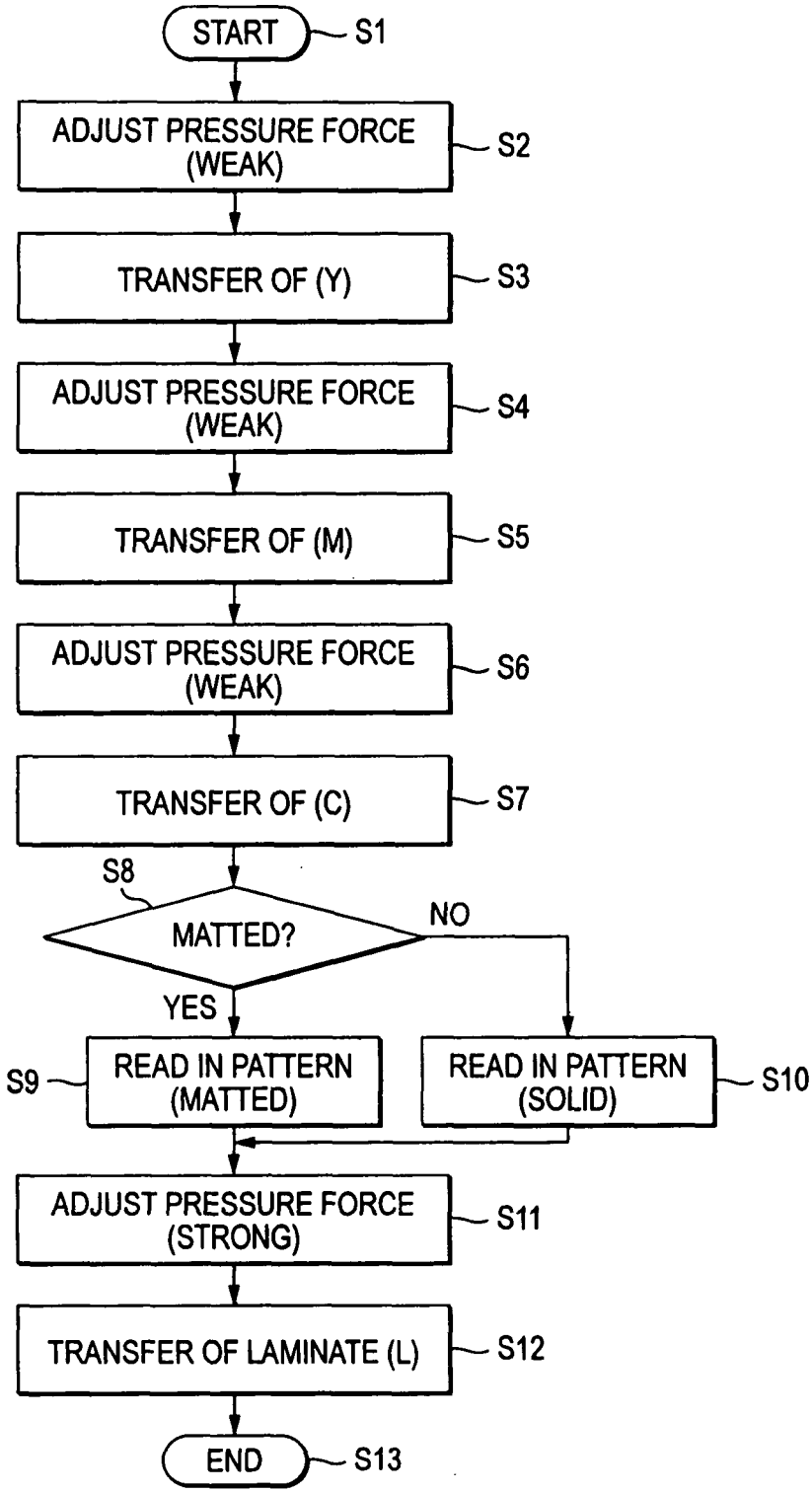
FIG. 9 is a flowchart illustrating a method of forming an image by the thermal printer of the embodiment.

FIG. 9 is a flowchart illustrating a method of forming an image by the thermal printer 10 of the present embodiment.

As shown in FIG. 9, after start of processing (step S1), the pressure force from the thermal head 20 (see FIG. 4) is adjusted to the minimum force necessary for transfer (step S2). The color ink of the yellow (Y) is transferred (step S3).

Similarly, the pressure force is adjusted to weaken it (step S4). In the next step S5, the color ink of the magenta (M) is transferred. In step S6, the pressure force is adjusted to weaken it again. In the next step S7, the color ink of the cyan (C) is transferred. Consequently, a color image can be formed on the roll paper 12 (see FIG. 3) by the steps S1-S7.

In this way, during transfer of the color inks (Y, M, C), the pressure force is adjusted to weaken it to obtain the minimum force necessary for transfer. A color image is formed in such a way that the surface layer 12*b* of the roll paper 12 shown in FIG. 3 is not crushed by the heat and pressure force used for transfer. After the color image is formed, a decision is made as to whether or not the image is matted (step S8). If the matting processing is done, the pattern (delustering or convexo-concave pattern such as mesh pattern for the matting processing is read in (step S9). On the other hand, if the image is not matted, control branches to step S10, where a pattern for creating a solid state (a uniform pattern for glossy finish) is read in.

In the subsequent step S11, the pressure force is adjusted according to the pattern read in. That is, the pressure force is adjusted to increase it according to the need in order to form a convexo-concave pattern such as for delustering or mesh pattern. This adjustment is made by appropriately rotating the eccentric cam 22 as shown in FIG. 4C. A transparent laminate layer is laminated on the color image by transferring the laminate ink (L) in step S12. The processing is ended in the final step S13.

The surface of the image formed in this way is effectively matted because a clear convexo-concave pattern is formed in the surface layer 12*b* of the roll paper 12 concomitantly with the transfer of the laminate ink (L) as shown in FIG. 7. That is, the method of forming an image by the thermal printer 10 of the present embodiment makes use of the principle that the portion of the surface layer 12*b* to which more heat and pressure force are applied by transfer has a deeper recess. When the color inks (Y, M, C) are transferred, crushing (recesses) by the pressure force is suppressed as much as possible to retain the resilience of the surface layer 12*b*. In the stage when the laminate ink (L) is transferred, the pressure force is adjusted to increase it such that the transferred pattern forms maximally vivid convexes and concaves in the surface layer 12*b*.

Accordingly, when the laminate ink (L) is transferred, the degree of surface glossiness, the feeling of roughness of the matted surface, or mesh pattern can be brought to a desired state by giving a convexo-concave pattern by adjusting the pressure force continuously obviously, intrinsic glossy surface owing to the laminate ink (L) can also be obtained unless any convexo-concave pattern is imparted during transfer.

While embodiments of the present invention have been described so far, the invention is not limited thereto. For example, the following various modifications and changes are possible.

(1) In the present embodiment, the roll paper 12 is used as printing paper. The paper is not limited to roll paper. Cut paper and other kinds of paper can also be used.

(2) In the present embodiment, the thermal head 20 is equipped with the pressure force-adjusting means made up of the eccentric cam 22, rotating shaft 22*a*, and spring 23 to permit the pressure force between the platen roller 15 and the head to be varied continuously. The pressure force-adjusting means may also be mounted on the platen roller 15. Furthermore, the pressure force-adjusting means is not limited to a combination of the eccentric cam 22 and spring 23. In addition, the printer may be so designed that the pressure force can be adjusted in steps.

It should be understood by those skilled in the art that various modifications, combinations, sub-combinations and alterations may occur depending on design requirements and other factors insofar as they are within the scope of the appended claims or the equivalents thereof.

What is claimed is:

1. A method of forming an image by a thermal printer having a thermal head on which plural heat-generating elements are arrayed and a platen mounted opposite to the thermal head, the printer using an ink ribbon and paper held between the thermal head and the platen, the thermal printer performing printing by causing the heat-generating elements to generate heat such that inks of the ink ribbon are transferred to the paper, the ink ribbon having a base film on which color inks and a transparent laminate ink are successively and repetitively arranged, the method comprising the step of:

forming convexes and concaves on a surface of the paper by varying a pressure force acting between the thermal head and the platen between when the color inks are transferred and when the laminate ink is transferred, and further wherein the pressure force acting on the thermal head and platen is greater when acting on the transparent laminate than when acting on the color inks, the pressure force being adjusted such that after the color image has been formed by application of the relatively lower application of force during ink transfer, the applied pressure is increased in order to selectively form a convexo-concave pattern to a depth that is substantially greater than a depth of depressions formed during ink transfer operations.

2. The method of forming an image with a thermal printer as set forth in claim 1, further comprising selectively adjusting the pressure force before application of each ink.

* * * * *